US010012459B1

(12) United States Patent
Stangl et al.

(10) Patent No.: US 10,012,459 B1
(45) Date of Patent: Jul. 3, 2018

(54) FIREARM OF THE ROTATING BOLT TYPE

(71) Applicant: STEYR MANNLICHER GmbH, Kleinraming (AT)

(72) Inventors: Herbert Stangl, St. Ulrich bei Steyr (AT); Thomas Mayrhauser, St. Florian (AT); Christian Hösz, Oberpetersdorf (AT); Wolfgang Geier, St. Ulrich bei Steyr (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 15/569,235

(22) PCT Filed: Feb. 10, 2016

(86) PCT No.: PCT/AT2016/050025

§ 371 (c)(1),
(2) Date: Oct. 25, 2017

(87) PCT Pub. No.: WO2016/172746

PCT Pub. Date: Nov. 3, 2016

(30) Foreign Application Priority Data

Apr. 27, 2015 (AT) ..... A 50338/2015

(51) Int. Cl.

| | |
|---|---|
| ***F41A 3/66*** | (2006.01) |
| ***F41A 21/48*** | (2006.01) |
| ***F41A 3/26*** | (2006.01) |
| *F41G 11/00* | (2006.01) |

(52) U.S. Cl.
CPC ..... *F41A 3/66* (2013.01); *F41A 3/26* (2013.01); *F41A 21/48* (2013.01); *F41G 11/003* (2013.01)

(58) Field of Classification Search
CPC ..... F41A 3/26; F41A 3/66; F41A 21/48
USPC ..... 42/16; 89/194
See application file for complete search history.

(56) References Cited

U.S. PATENT DOCUMENTS

| | | | | |
|---|---|---|---|---|
| 8,307,575 | B1 * | 11/2012 | Battaglia | F41A 3/64 42/75.03 |
| 8,667,882 | B1 * | 3/2014 | Larson | F41A 3/66 89/140 |
| 9,664,465 | B1 * | 5/2017 | Viviano | F41A 3/26 |
| 2005/0229463 | A1 | 10/2005 | Tashjian | |
| 2006/0156606 | A1 * | 7/2006 | Robinson | F41A 15/12 42/7 |

(Continued)

FOREIGN PATENT DOCUMENTS

| | | |
|---|---|---|
| AT | 51314 A4 | 2/2014 |

OTHER PUBLICATIONS

English translation of the International Preliminary Report on Patentability for PCT/AT2016/050025 dated Nov. 2, 2017.

(Continued)

*Primary Examiner* — Bret Hayes
(74) *Attorney, Agent, or Firm* — Hoffmann & Baron, LLP

(57) ABSTRACT

A firearm of the rotating bolt type includes a housing part made of plastic or metal, a metal bolt carrier guide, a bolt carrier that is guided by the bolt carrier guide and that has a bolt head rotatably mounted in it, and, held by the housing part, a metal barrel nut in which a barrel can be fixed and in which the bolt head can be locked. The bolt carrier guide is directly connected with the barrel nut so that it is rigid with respect to movement, at least in the longitudinal direction of the firearm.

10 Claims, 3 Drawing Sheets

(56) References Cited

U.S. PATENT DOCUMENTS

| | | | | |
|---|---|---|---|---|
| 2011/0126443 | A1 | 6/2011 | Sirois | |
| 2012/0042554 | A1* | 2/2012 | Rich | F41A 35/02 42/16 |
| 2012/0216439 | A1 | 8/2012 | Barrett et al. | |
| 2014/0000142 | A1 | 1/2014 | Patel | |
| 2015/0267984 | A1* | 9/2015 | Kokinis | F41A 3/66 42/14 |

OTHER PUBLICATIONS

Austrian Office Action for A 50338/2015 dated Nov. 11, 2015.
International Preliminary Report on Patentability (IPRP) for PCT/AT2016/050025 dated Jul. 21, 2017.

* cited by examiner

FIREARM OF THE ROTATING BOLT TYPE

This invention relates to a firearm of the rotating bolt type comprising a housing part made of plastic or metal, a metal bolt carrier guide, a bolt carrier that is guided by the bolt carrier guide so that it can be moved longitudinally with respect to the housing part and that has a bolt head rotatably mounted in it, and, held by the housing part, a metal barrel nut in which a barrel can be fixed and in which the bolt head can be locked by rotation so that it is aligned with the barrel.

Firearms of the rotating bolt type are common, for example, in the form of army rifles of the AR-10/15 design, which also includes the American assault rifle M16. To keep the weight of such firearms as small as possible, their housing parts are usually made of plastic or light metal, e.g., aluminum. By contrast, parts such as the barrel, the barrel nut, and the bolt carrier with the bolt head, which are subject to strong stresses, are made of steel. Due to the poor antifriction properties of the steel of the bolt carrier against the aluminum or plastic of the housing part, intensive treatment with special lubricants is necessary. This makes the weapon more sensitive to soiling by powder smoke, sand, mud, ice, etc., whose particles adhere to the lubricant film, substantially reducing the lubricant effect. Therefore, frequent and intensive cleaning is prescribed for the M16, to avoid malfunctions. Austrian patent no. 513.144 of the same applicant discloses putting slide rails made of a material different from the housing material on the inner surface of the housing part to guide the bolt carrier in the housing part, allowing the bolt carrier to slide in the housing part with only a little lubricant, or even without any at all.

This invention has the goal of further improving the prior art and creating a firearm with high stability and precision.

The invention achieves this goal with a firearm of the type mentioned at the beginning which is characterized in that the bolt carrier guide is, at least in the longitudinal direction of the firearm, directly connected with the barrel nut so that it is rigid with respect to movement.

Such a direct connection between the bolt carrier guide and the barrel nut ensures reliable function of the rotating bolt over a long service life of the firearm, since the movable bolt carrier is permanently precisely supported with respect to the barrel nut and the barrel. Since the largest forces occur in the longitudinal direction of the firearm, a connection that it is rigid with respect to movement only in this direction is already sufficient to achieve this support effect. The parts that are subject to strong stresses, i.e., the barrel, the barrel nut, the bolt carrier guide, and the bolt carrier with the bolt head, which have a decisive influence on the durability, stability, and precision of the firearm, can be dimensioned and built according to their requirements, while the housing and the housing part are largely free of such stress and thus can be built in an especially weight-saving way. The bolt carrier is securely guided in the bolt carrier guide, so that their material pairing can be matched with respect to good antifriction properties and robustness. The barrel, barrel nut, and rotating bolt can, if desired, also be replaceable, in order, e.g., to replace worn out parts and/or to change the caliber of an existing firearm.

In order to create a simple, stable, and nevertheless detachable connection between the bolt carrier guide and the barrel nut, it is favorable for the bolt carrier guide to be connected with the barrel nut through a tongue-and-groove connection that produces rigidity in the longitudinal direction of the firearm.

According to another advantageous embodiment, the bolt carrier guide is connected with the barrel nut by a screw connection, welding, pressing, or something similar. This produces a connection of the bolt carrier guide with the barrel nut that it is rigid with respect to movement in all directions, which leads to even higher stability of the firearm and is also either permanent or detachable, depending on the embodiment.

It is especially favorable if the bolt carrier guide additionally has a frictional or form-fit connection with the housing part. This ensures secure seating of the bolt carrier guide on the housing part. This also increases the precision of the firearm when combined with, e.g., a sighting device on the housing part. Furthermore, the forces absorbed by the bolt carrier guide can be selectively transferred to the housing part.

According to an especially advantageous embodiment, the bolt carrier guide has an essentially C-shaped cross section, each end of the C forming an inward directed rail, which rails engage into lateral longitudinal grooves of the bolt carrier. A bolt carrier guide shaped in this way is simple to produce and is itself already especially stable, also allowing it to be produced in a way that saves material and thus weight. Furthermore, the inward directed rails cooperating with the longitudinal grooves on the side of the bolt carrier produce a permanently secure and precise sliding seat, thereby preventing tilting of the bolt carrier in the bolt carrier guide and consequently also preventing jamming and/or damage of the firearm.

It is especially favorable if the bolt carrier guide has anchors on which a grip part is directly mounted. In this way, forces, especially those acting in the longitudinal direction of the weapon, are carried away directly to the grip part and to a buttstock that is usually connected with it in such firearms, and onto the shoulder of a rifleman. This takes even more force off the housing part. In this case, the bolt carrier guide represents a central element for connection of all parts of the firearm that are essential for its function.

In another advantageous variant of the firearm, the bolt carrier guide has an opening for connection of a magazine well and for the passage of a firing mechanism. This ensures the usual feed of ammunition and also usual firing; such a bolt carrier guide has a frame-like structure, which saves weight, while having comparable stability.

The invention is explained in detail below using a sample embodiment that is illustrated in the attached drawings. The drawings are as follows.

Figure 1:
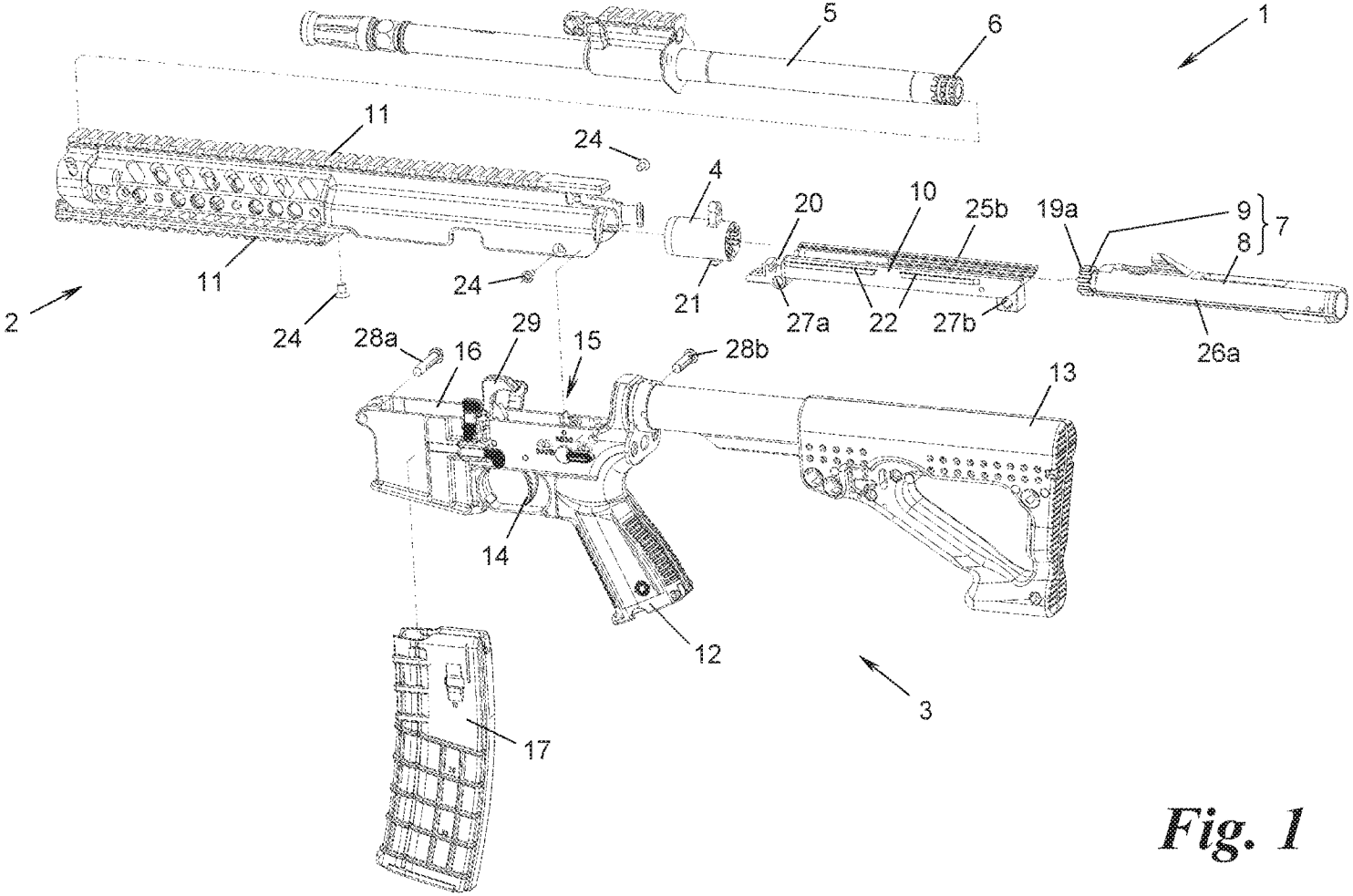
FIG. 1 shows an exploded perspective view of an inventive firearm of the rotating bolt type, viewed at an angle from above.

According to FIG. 1 a firearm 1 has a housing part 2 and a grip part 3. The housing part 2 holds a barrel nut 4, in which a barrel 5 can be fixed from the front, e.g., by means of a bayonet coupling 6. The firearm 1 is, e.g., a portable firearm, for instance a semiautomatic or automatic rifle.

The firearm 1 has a rotating bolt 7 with a bolt carrier 8 and a bolt head 9 that is mounted in the bolt carrier 8 so that the bolt head 9 is at least rotatable, as a rule also slightly axially movable.

The bolt carrier 8 is guided in a bolt carrier guide 10 so that it is, with respect to the housing part 2, longitudinally movable, i.e., movable in the direction of the longitudinal axis L (FIG. 2) of the firearm 1, between a front end position, in which the bolt head 9 is locked by rotation in the barrel nut 4 to align with the barrel 5, and a rear end position in which the rotating bolt 7 is open.

The housing part 2 serves essentially to protect the mechanically movable elements of the firearm 1, e.g., the rotating bolt 7, from contact and soiling, for protection from touching the barrel 5, which is hot in operation, and to fasten attachments to the firearm 1, e.g., on a Picatinny rail 11. In contrast to the parts of the firearm 1 such as the barrel 5, the barrel nut 4, the rotating bolt 7, and the bolt carrier guide 10, which are subject to strong mechanical stresses in operation, the housing part 2—and moreover also the grip part 3—can be made of a light material whose mechanical properties are not as good. In this case, the housing part 2 is made of aluminum or plastic, and the barrel 5, the barrel nut 4, the rotating bolt 7, and the bolt carrier guide 10 are made of steel.

The grip part 3 comprises, in addition to a pistol grip 12 and a buttstock 13, which can optionally be adjustable and/or combined into one element, a trigger 14 to operate a firing mechanism 15 and a magazine well 16 for attachment of a magazine 17 to feed new ammunition to the cartridge chamber 18 (FIG. 2) of the barrel 5.

The structure and action of the bolt carrier guide 10 are described below on the basis of FIG. 2 through FIG. 7.

Figure 2:
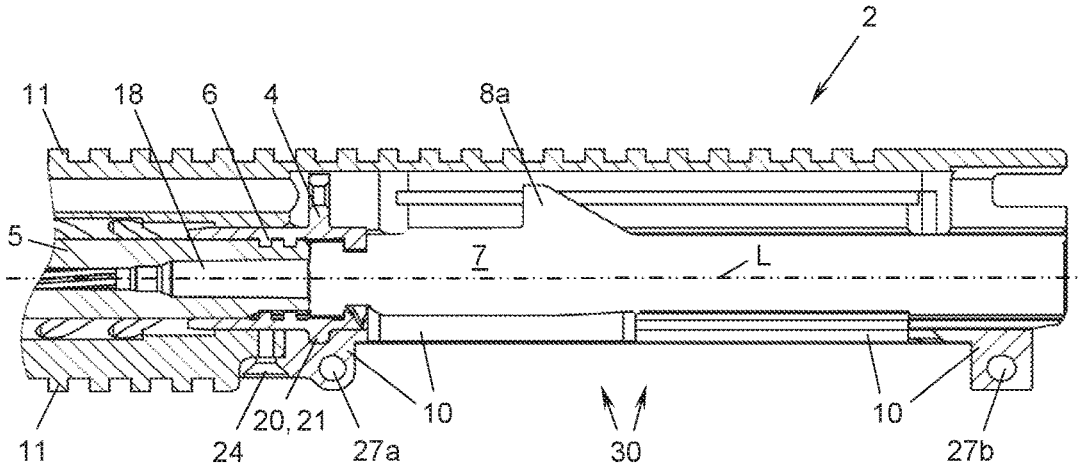
FIG. 2 shows a cutaway portion of the firearm of FIG. 1 in the area of the bolt carrier guide, in longitudinal section.
Figure 3:
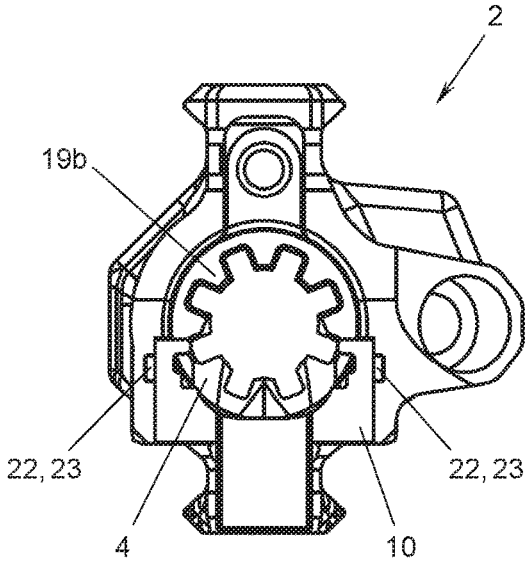
FIG. 3 shows a rear view of the cutaway portion of FIG. 2, in the longitudinal direction of the firearm.
Figure 6:
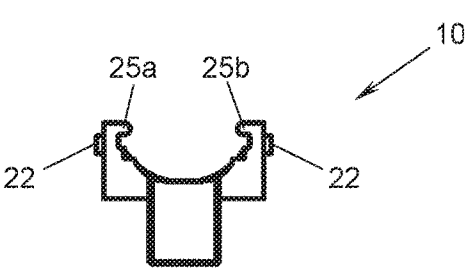
FIG. 4 through FIG. 6 show the bolt carrier guide of FIG. 2 in a perspective view, viewed at an angle from above (FIG. 4), in a side view (FIG. 5), and in a rear view (FIG. 6)
Figure 7:
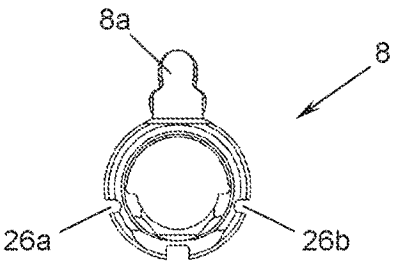
FIG. 7 is a rear view of the bolt carrier of the firearm of FIG. 1.

A repeating process begins after the firearm 1 is fired with the rotating bolt 7, which for clarity is shown only in outline in FIG. 2, first being in its front end position (shown in FIG. 2), in which the bolt head 9 is locked by rotation in a type of bayonet coupling, with its outward directed lugs 19*a* (FIG. 1) behind the inward directed lugs 19*b* (FIG. 3) of the barrel nut 4. Then, the repeating process involves the bolt head 9 rotating in the bolt carrier 8, e.g., in a way known in the art with the help of a sliding block guide in the bolt carrier 8, unlocking the bolt head 9 from the barrel nut 4, after which the bolt carrier 8 and bolt head 9 together slide into the rear end position, possibly withdrawing a spent cartridge case (not shown) from the cartridge chamber 18 and ejecting it. The next step of the repeating process involves new ammunition being fed from the magazine 17 through the magazine well 16 and pushed into the cartridge chamber 18 by the rotating bolt 7, which is being pressed by spring force back into its front end position, the bolt head 9 once again being locked by rotation in the barrel nut 4, e.g., through a sliding block guide. For automatic repeating, the bolt carrier 8 has a key 8*a* for application of a gas pressure-operated linkage (not shown in FIG. 2).

The bolt carrier guide 10 is connected with the barrel nut 4 directly, i.e., in direct contact with it, rigidly with respect to movement, at least in the longitudinal direction, i.e., in the direction of the longitudinal axis L of the firearm 1. To accomplish this in the example shown, the bolt carrier guide 10 has, running transverse to the longitudinal axis L and facing the barrel nut 4, a groove 20, into which a tongue 21 of the barrel nut 4 engages, producing rigidity with respect to movement in the longitudinal direction of the firearm 1. It goes without saying that alternatively the groove 20 and the tongue could be interchanged; furthermore, another type of connection that is rigid with respect to movement could be selected, e.g., a pin or something similar of one of the two components, barrel nut 4 and bolt carrier guide 10, projecting into a recess on the other component. Alternatively or additionally, the bolt carrier guide 10 can be permanently or detachably connected with the barrel nut 4 by a screw connection, welding, pressing, or something similar.

If desired, the bolt carrier guide 10 can additionally have a frictional or form-fit connection with the housing part 2. To accomplish this in the example shown in FIG. 3 through FIG. 6, the bolt carrier guide 10 has, on the side, projections 22, which are inserted into depressions 23 of the housing part 2. Alternatively or additionally, the bolt carrier guide 10 can be cemented with the housing part 2, and/or be connected by means of one or more pins, screws, or rivets 24 (see FIG. 1 and FIG. 2.

In this example, the cross section of the bolt carrier guide 10 is essentially shaped like a letter "C" lying on its side. Both ends of the C form inward directed rails 25*a*, 25*b* that engage in longitudinal grooves 26*a*, 26*b* on the side of the bolt carrier 8. Thus, the C-shaped bolt carrier guide 10 partly wraps around the bottom of the bolt carrier 8, whose cross section is essentially approximately circular, except for the key 8*a*, and the bolt carrier 8 is supported so that it can slide on the rails 25*a*, 25*b* of the bolt carrier guide 10, which engage into the longitudinal grooves 26*a*, 26*b* of the bolt carrier 8. Alternatively, the longitudinal grooves 26*a*, 26*b* and rails 25*a*, 25*b* could each be arranged on the other part, bolt carrier 8 or bolt carrier guide 10; furthermore, only a single rail, e.g., a T-shaped rail, could engage into a groove that is complementary to it, or the C of the bolt carrier guide 10 could wrap around the bolt carrier 8 over more than half of its circumference.

The grip part 3 could be put on the housing part 2 and close it off on the bottom; however, in this case the bolt carrier guide 10 has anchors for this purpose, here front and rear transverse holes 27*a*, 27*b*. The grip part 3 is put directly on these anchors 27*a*, 27*b*, e.g., with pins 28*a*, 28*b*. Alternatively, the anchors could be screw, rivet, catch, or similar anchors; furthermore, the grip part 3 could be put on the bolt carrier guide 10 with the help of only a single anchor.

Figure 4:
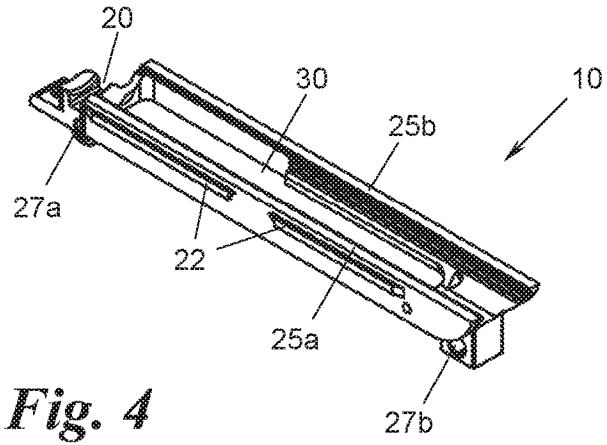
Figure 5:
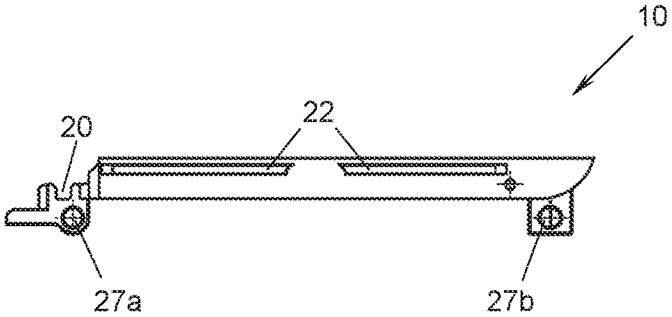

For connection of the magazine well 16 and for the passage of the firing mechanism 15 that is actuated by the trigger 14 and that uses, e.g., a hammer 29 to actuate a firing pin mounted in the rotating bolt 7, the bolt carrier guide 10 has an opening 30, which in this example extends over wide parts of the bottom of the "C" (see FIG. 4). Depending on the design of the grip part 3, the opening 30 can be continuous or be subdivided by one or more crossbars of the bolt carrier guide 10.

The invention is not limited to the presented embodiments, but rather comprises all variants, combinations, and modifications that fall within the scope of the appended claims.

What is claimed is:

1. A firearm having a longitudinal direction and comprising:

a housing part made of plastic or metal;

a bolt with a bolt carrier and a bolt head rotatably mounted in the bolt carrier;

a bolt carrier guide made of metal, the bolt carrier being guided by the bolt carrier guide in the longitudinal direction of the firearm; and a metal barrel nut which is held by the housing part and in which a barrel can be fixed, and in which the bolt head can be locked by rotation so that the bold head is aligned with the barrel;

wherein the housing part is configured to protect the bolt in a position in which the bolt head is locked by rotation in the barrel nut from contact or soiling; and wherein the bolt carrier guide is directly connected with the barrel nut so that the bolt carrier guide is rigid with respect to movement, at least in the longitudinal direction of the firearm.

2. The firearm according to claim 1, wherein the bolt carrier guide is connected with the barrel nut through a tongue-and-groove connection that produces rigidity in the longitudinal direction of the firearm.

3. The firearm according to claim 2, wherein the bolt carrier guide is connected with the barrel nut by a screw connection, by welding, or by pressing.

4. The firearm according to claim 2, wherein the bolt carrier guide additionally has a frictional or form-fit connection with the housing part.

5. The firearm according to claim 2, wherein the bolt carrier guide has an essentially C-shaped cross section, each end of the C forming an inward directed rail, which rails engage into lateral longitudinal grooves of the bolt carrier.

6. The firearm according to claim 1, wherein the bolt carrier guide is connected with the barrel nut by a screw connection, by welding, or by pressing.

7. The firearm according to claim 1, wherein the bolt carrier guide additionally has a frictional or form-fit connection with the housing part.

8. The firearm according to claim 1, wherein the bolt carrier guide has an essentially C-shaped cross section, each end of the C forming an inward directed rail, which rails engage into lateral longitudinal grooves of the bolt carrier.

9. The firearm according to claim 1, wherein the bolt carrier guide has anchors on which a grip part is directly mounted.

10. The firearm according to claim 1, wherein the bolt carrier guide has an opening for connection of a magazine well and for the passage of a firing mechanism.

* * * * *